US010683629B2

(12) United States Patent
Creede

(10) Patent No.: US 10,683,629 B2
(45) Date of Patent: Jun. 16, 2020

(54) ICE RAMP SYSTEM, BRACKET, AND METHOD

(71) Applicant: Pro-Built Docks, LLC, Kattskill Bay, NY (US)

(72) Inventor: John Michael Creede, Kattskill Bay, NY (US)

(73) Assignee: Pro-Built Docks, LLC, Kattskill Bay, NY (US)

( * ) Notice: Subject to any disclaimer, the term of this patent is extended or adjusted under 35 U.S.C. 154(b) by 0 days.

(21) Appl. No.: 16/597,985

(22) Filed: Oct. 10, 2019

(65) Prior Publication Data

US 2020/0115869 A1 Apr. 16, 2020

Related U.S. Application Data

(60) Provisional application No. 62/743,749, filed on Oct. 10, 2018.

(51) Int. Cl.

| | |
|---|---|
| ***E02B 15/02*** | (2006.01) |
| ***E02D 5/60*** | (2006.01) |
| ***E02B 17/00*** | (2006.01) |

(52) U.S. Cl.

CPC ..... *E02B 17/0021* (2013.01)

(58) Field of Classification Search

CPC ..... E02B 17/0021; E02B 15/02; E02D 5/60

See application file for complete search history.

(56) References Cited

U.S. PATENT DOCUMENTS

| | | | | | |
|---|---|---|---|---|---|
| 2,449,963 | A * | 9/1948 | Ward | E02B 1/00 | 405/61 |
| 3,370,432 | A * | 2/1968 | Butler | E02B 17/0021 | 405/216 |
| 3,669,052 | A * | 6/1972 | Schirtzinger | B63B 35/12 | 405/217 |
| 3,672,175 | A * | 6/1972 | Mason | E02B 17/0021 | 405/211 |
| 3,696,624 | A * | 10/1972 | Bennett | B63B 35/12 | 405/211 |
| 3,759,046 | A * | 9/1973 | Anders | E02B 17/0021 | 405/211 |
| 3,807,179 | A * | 4/1974 | Stone | E02B 17/0021 | 405/61 |
| 4,037,424 | A * | 7/1977 | Anders | B63B 35/4413 | 405/207 |
| 4,063,428 | A * | 12/1977 | Waas | E02B 17/0021 | 405/212 |
| 4,077,225 | A * | 3/1978 | Lichtenberger | E02B 17/0021 | 114/42 |
| 4,103,504 | A * | 8/1978 | Ehrlich | B63B 35/4413 | 405/211 |

(Continued)

*Primary Examiner* — Benjamin F Fiorello

(74) *Attorney, Agent, or Firm* — Hoffman Warnick LLC

(57) ABSTRACT

An ice ramp system for a dock including a catch plate adapted for horizontal mounting on a dock side surface of a dock; a plurality of ice ramps; a plurality of brackets, each bracket including a triangular cross-section with a bisecting element; an angled ice ramp support face for angularly supporting an ice ramp; a notch at a lower end of the support face for receiving an edge of an ice ramp; a hook that extends from an upper end of the support face that is mountable to a dock top surface; and a backplate having a downwardly extending tongue that mates with the catch plate.

20 Claims, 6 Drawing Sheets

(56) References Cited

U.S. PATENT DOCUMENTS

| | | | | | |
|---|---|---|---|---|---|
| 4,200,409 | A * | 4/1980 | Mougin | B63B 35/086 | 405/211 |
| 4,230,423 | A * | 10/1980 | Oshima | E02B 17/0021 | 114/42 |
| 4,265,569 | A * | 5/1981 | Gefvert | E02B 17/0021 | 405/217 |
| 4,300,855 | A * | 11/1981 | Watson | E02B 15/02 | 405/211 |
| 4,464,083 | A * | 8/1984 | Wathey | E02B 17/0021 | 405/216 |
| 4,479,742 | A * | 10/1984 | Bruce | E02D 23/02 | 405/205 |
| 4,505,618 | A * | 3/1985 | Yashima | B63B 35/4413 | 405/211 |
| 4,512,683 | A * | 4/1985 | Cosenza | E02D 5/60 | 405/211 |
| 8,347,801 | B2 * | 1/2013 | Denise | B63B 35/44 | 114/40 |
| 9,567,982 | B1 * | 2/2017 | Gozewski | F03D 80/40 | |
| 2007/0095269 | A1 * | 5/2007 | Boutaghou | E02B 3/20 | 114/219 |
| 2010/0074686 | A1 * | 3/2010 | Towley, III | E02B 3/06 | 405/26 |
| 2014/0341658 | A1 * | 11/2014 | Gagnon | E02B 17/0021 | 405/211 |

* cited by examiner 10
36
34
41
41
41
38
39
12
32
14
32
32
40
22
20
16
14
23
R
30

DOCK-0001

ICE RAMP SYSTEM, BRACKET, AND METHOD

TECHNICAL FIELD

The subject matter of this invention relates to protecting docks from ice damage and more particularly to a system for securing an ice ramp to a dock, a bracket for a component of the system, and a method for securing the system design to the dock.

BACKGROUND

Damage to marine docks caused by ice during the winter months can be a costly problem. Various approaches are utilized to protect docks, including the use of de-icers, bubblers, etc. Unfortunately, such approaches are not foolproof, as they generally require electricity, time and temperature controllers, wiring, etc. In cases where a dock services a seasonal vacation home, it is not always practical for the owner to ensure proper operation.

SUMMARY

A first aspect of the disclosure provides an ice ramp system for a dock comprising a catch plate adapted for horizontal mounting on a dock side surface; a plurality of ice ramps; a plurality of brackets, each bracket comprising a triangular cross-section with a bisecting element; an angled ice ramp support face for angularly supporting an ice ramp; a notch at a lower end of the support face for receiving an edge of an ice ramp; a hook that extends from an upper end of the support face that is mountable to a dock top surface; and a backplate having a downwardly extending tongue that mates with the catch plate.

A second aspect of the disclosure provides a bracket for mounting an ice ramp to a dock, comprising: a triangular cross-section with a bisecting element; an angled ice ramp support face for angularly supporting an ice ramp; a notch at a lower end of the support face for receiving an edge of an ice ramp; a hook that extends from an upper end of the support face that is mountable to a dock top surface; and a backplate having a downwardly extending tongue that mates with the catch plate.

A third aspect of the disclosure provides a method for securing an ice ramp system to a dock, comprising: securing a catch plate horizontally to a dock side surface; securing a support rail to a dock top surface; securing a plurality of brackets to a dock side surface, including securing a hook of each bracket to the support rail, and securing a tongue of each bracket to the catch plate; and securing a plurality of ice ramps to the brackets.

BRIEF DESCRIPTION OF THE DRAWINGS

These and other features of this invention will be more readily understood from the following detailed description of the various aspects of the invention taken in conjunction with the accompanying drawings in which.

Figure 1:
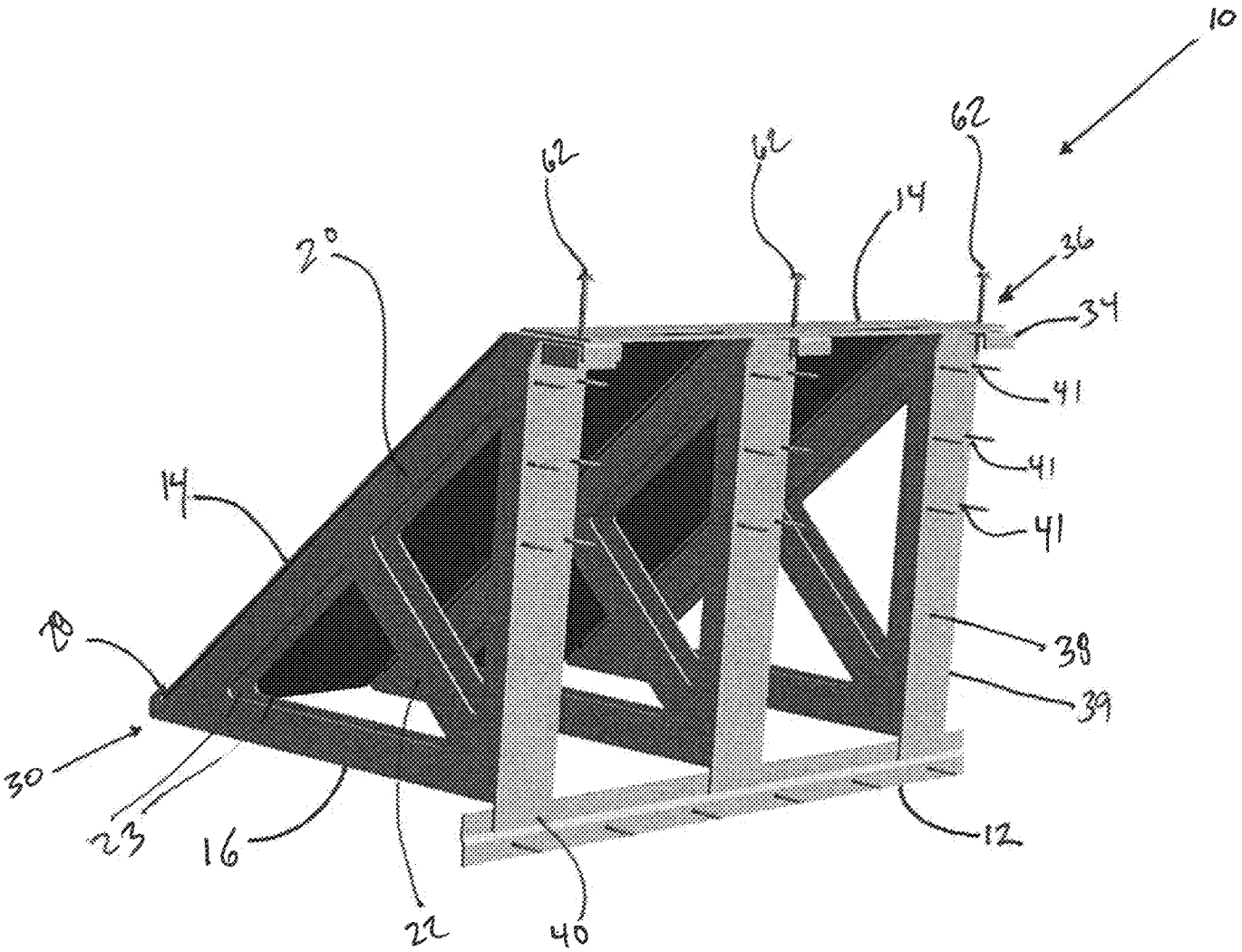
FIG. 1 shows an ice ramp system according to embodiments.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION

One approach to avoiding the above shortcomings associated with ice damage on a dock is to utilize an ice ramp such as that provided by Pro-Built Docks, LLC, in Kattskill Bay, N.Y. Ice ramps are temporarily installed along the length of the dock, and allow the ice to expand up and over the dock avoiding damage below the dock.

One of the challenges with the use of an ice ramp however is to ensure that the ramp is attached to the dock in such a manner that it does not cause unnecessary stress on the dock and result in a mechanical failure.

Figure 2:
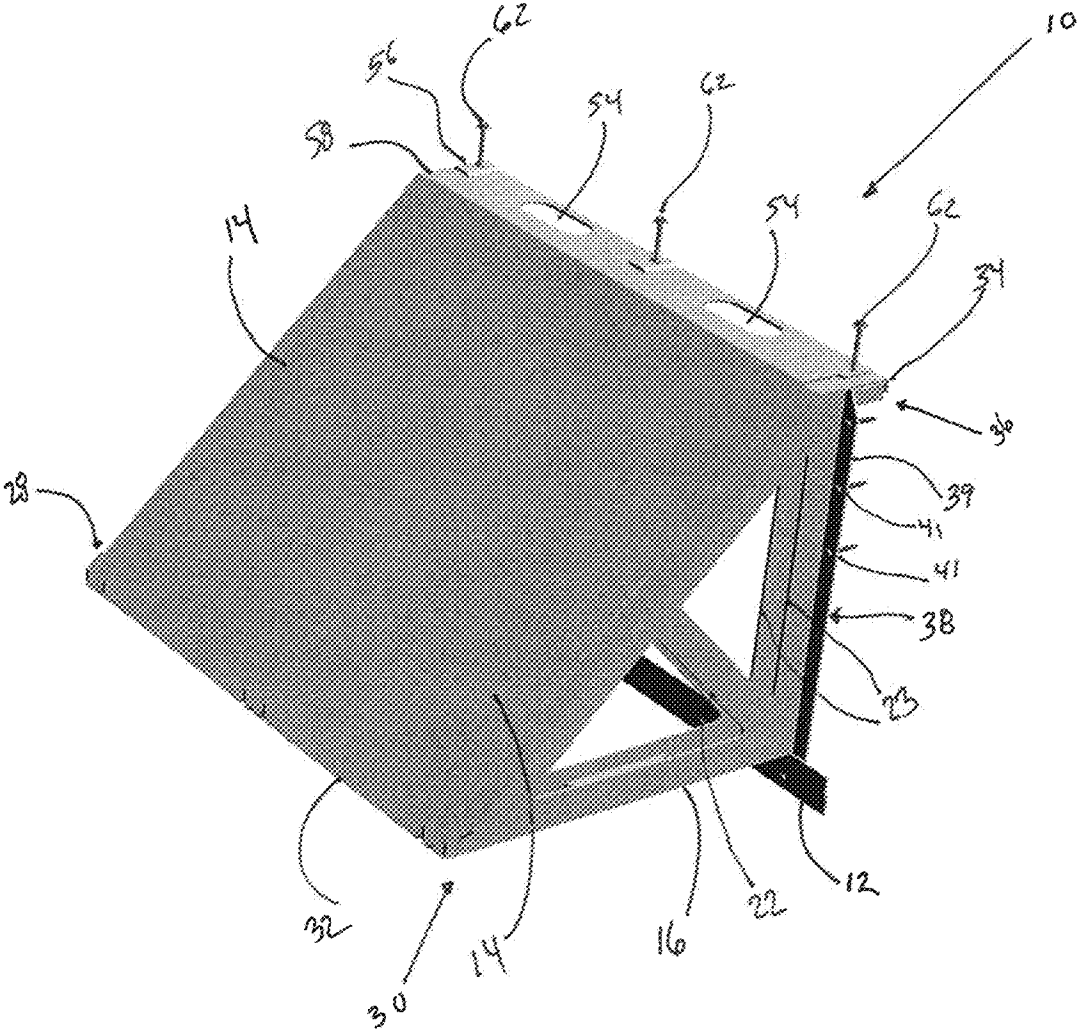
FIG. 2 shows an ice ramp system according to embodiments.
Figure 3:
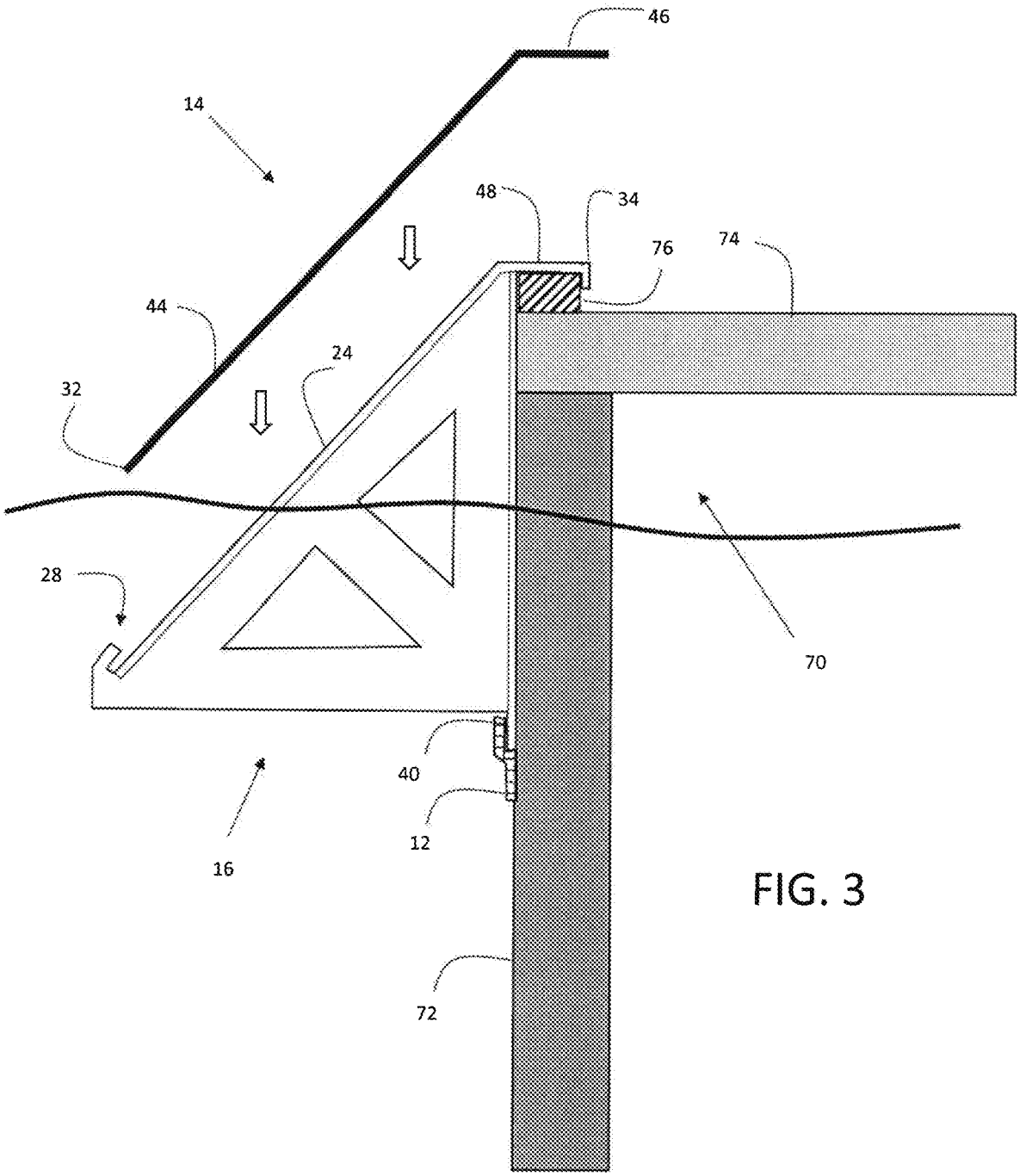
FIG. 3 shows an ice ramp system attached to a dock according to embodiments.

Referring now to the drawings, FIG. 1 and FIG. 2 depict rear and front isometric views of ice ramp system 10. FIG. 3 depicts a side view of ice ramp system 10 attached to a dock 70. Ice ramp system 10 may include a catch plate 12 adapted for horizontal mounting on a dock side surface 72, a plurality of ice ramps 14, and a plurality of brackets 16. Ice ramp system 10 and various components of the ice ramp system 10 described herein may be made of metal, plastic, or other materials with sufficient strength and rigidity to secure ice ramp system 10 to the dock 70 and withstand shearing forces from ice.

Figure 4:
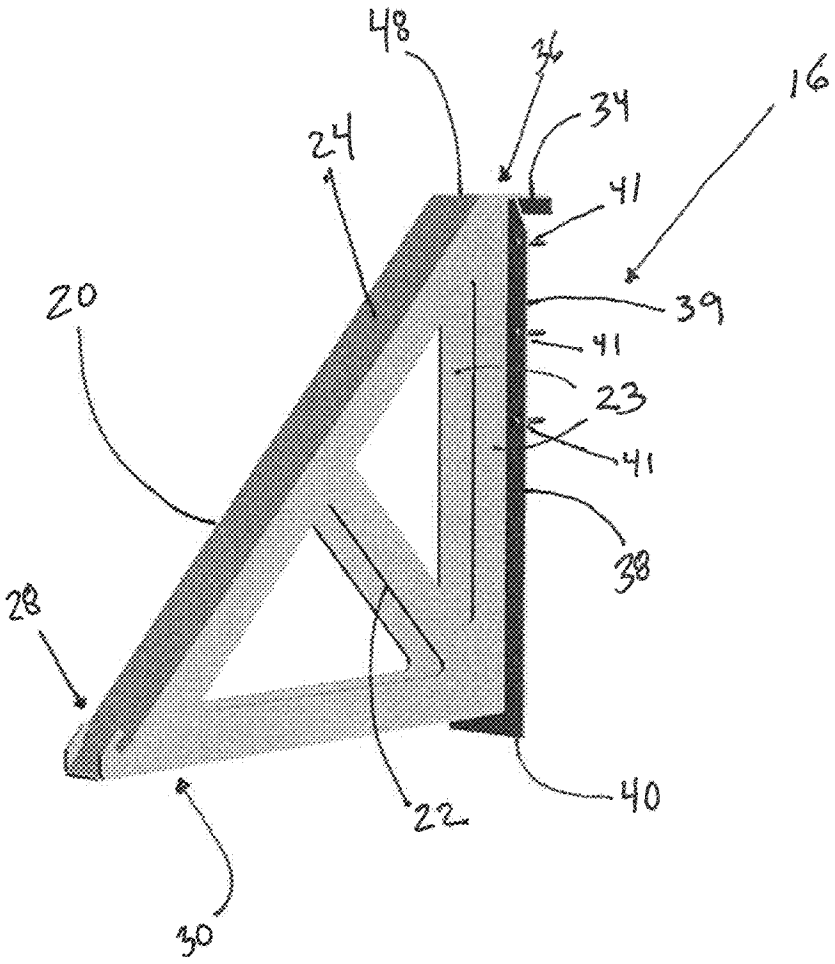
FIG. 4 shows a bracket according to embodiments.

FIG. 4 depicts a bracket 16 for ice ramp system 10. Bracket 16 may include a triangular cross-section 20 with a bisecting element 22, an angled ice ramp support face 24 for angularly supporting an ice ramp 14, a notch 28 at a lower end 30 of the support face 24 for receiving an edge 32 of an ice ramp 14, a hook 34 that extends from an upper end 36 of the support face 24 that is mountable to a dock top surface 74, and a backplate 38 having a downwardly extending tongue 40 that mates with the catch plate 12.

Triangular cross-section 20 may be comprised of two or more co-planar wall sections 23. Prior art brackets have several drawbacks including: (1) tubular design of the members allows water to enter, freeze, move around etc., which results in undue stress being placed on the brackets and dock; and (2) there are a large number of separate parts that must be welded together that drive up manufacturing costs. Co-planar wall sections 23 allow water to flow around bracket 16 and water will not freeze inside bracket 16.

Triangular cross-section 20 may be approximately an isosceles triangular shape. Angled ice ramp support face 24 may be at approximately 45 degrees to the isosceles triangular shaped triangular cross-section 20.

Backplate 38 may include flanged side sections 39. Flanged side section 39 mount approximately flush to dock side surface 72. Backplate 38 may include screw holes 41 that may accommodate screws, nails, etc., for securing backplate 38 to dock side surface 72.

Figure 5:
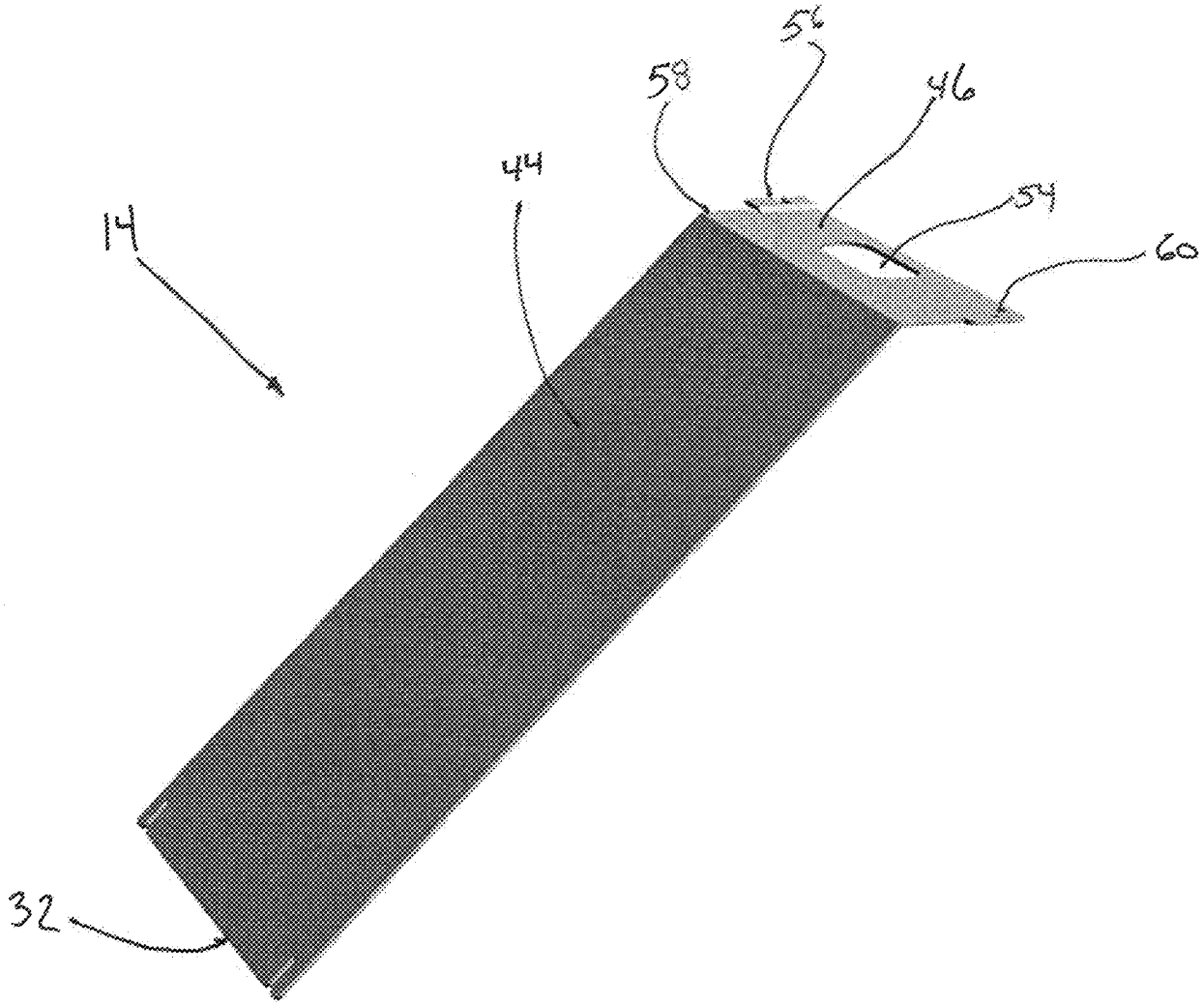
FIG. 5 shows an ice ramp according to embodiments.

FIG. 5 depicts an ice ramp 14 for ice ramp system 10. Ice ramp 14 may include an angled surface 44 and an ice ramp top surface 46 to rest both on the support face 24 and upper surface 48 of a bracket 16, respectively. The ice ramp 14 may be bent approximately 125-145 degrees forming the angled surface 44 and the ice ramp top surface 46 for each ice ramp 14. Ice ramp 14 may include a handle 54 in the ice ramp top surface 46. Ice ramp top surface 46 may include a flange 56 extending from a side edge 58. Flange 56 may be connectable to an adjacent ice ramp top surface 46 of an adjacent ice ramp 14. In one embodiment, flange 56 may include a hole 60 that is alignable with a hole 60 in the adjacent ice ramp 14 to form a pair of aligned holes 60.

Ice ramp system 10 may include a bolt 62 for securing the flange 56 with the adjacent ice ramp 14 via the aligned holes 60. Alternatively, a peg or other device may be inserted through the aligned holes 60 to secure adjacent ice ramps 14. Other mechanisms for securing adjacent ice ramps 14 could likewise be utilized (e.g., clamps, ubolts, etc.). Hook 34 may be angled to fit over a support rail 76 to the dock 70 thus securing ice ramp system 10 to the dock 70. Support rail 76 may be made of wood, for example a length of 2×4, metal, plastic, or any other material that fits under hook 34 and that may be attached to dock 70. Angle of the hook 34 may be approximately 90 degrees relative to the dock top surface 74.

Catch plate 12 may include an offset 64 along a top edge 66 to receive the tongue 40. Offset 64 of the catch plate 12 allows a first section 68 to be attached to the dock and a second section 70 leaving a gap 72 between the second section 70 and the dock thus securing ice ramp system 10 to the dock.

Figure 6:
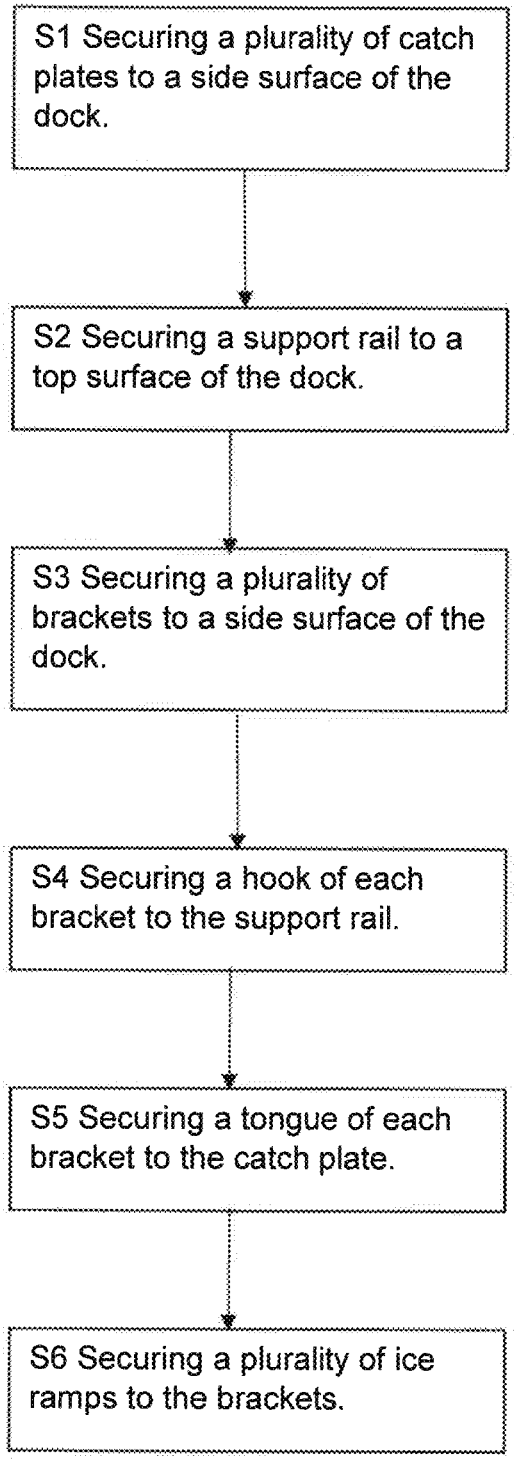
FIG. 6 shows a flow diagram for a method of installing an ice ramp system according to embodiments.

Referring to FIG. 6, a method for securing the ice ramp system 10 to the dock 70 may include securing catch plate 12 horizontally to the dock side surface 72 S1; securing the support rail to the dock top surface 74 S2; and securing the plurality of brackets 16 to the dock side surface 72 S3. Securing the plurality of brackets 16 to the dock side surface 72 S3 may include securing the hook 34 of each bracket 16 to the support rail 76 S4 and securing the tongue 40 of each bracket 16 to the catch plate 12 S5. After securing the plurality of brackets 16 to the dock side surface 76 S3, method may include securing the plurality of ice ramps 14 to the brackets 16 S6.

Note that while the terms top, bottom, side, etc., are used throughout, the terms are not intended to limiting, but rather are used to provide a relative positioning of the components of the ice ramp system, bracket, and method.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

What is claimed is:

1. An ice ramp system for a dock, comprising:
- a catch plate adapted for horizontal mounting on a dock side surface;
- a plurality of ice ramps;
- a plurality of brackets, each bracket comprising:
  - a triangular cross-section with a bisecting element;
  - an angled ice ramp support face for angularly supporting an ice ramp;
  - a notch at a lower end of the support face for receiving an edge of an ice ramp;
  - a hook that extends from an upper end of the support face that is mountable to a dock top surface; and
  - a backplate having a downwardly extending tongue that mates with the catch plate.

2. The system of claim 1, wherein each ice ramp includes an angled surface and an ice ramp top surface to rest both on the support face and upper surface of a bracket, respectively.

3. The system of claim 2, wherein the angle of the ice ramp is approximately 125-145 degrees forming the angled surface and the ice ramp top surface for each ice ramp.

4. The system of claim 3, wherein the ice ramp top surface of the ice ramp has a handle.

5. The system of claim 3, wherein the ice ramp top surface of the ice ramp has a flange extending from a side edge.

6. The system of claim 5, wherein the flange is connectable to an ice ramp top surface of an adjacent ice ramp.

7. The system of claim 6, wherein the flange includes a hole that is alignable with a hole in the adjacent ice ramp to form a pair of aligned holes.

8. The system of claim 7, further comprising a bolt for securing the flange with the adjacent ice ramp via the aligned holes.

9. The system of claim 1, wherein the hook is angled to fit over a support rail on the dock.

10. The system of claim 1, wherein the angle of the hook is approximately 90 degrees relative to the dock top surface.

11. The system of claim 1, wherein the bracket is comprised of two co-planar wall sections.

12. The system of claim 1, wherein the catch plate includes an offset along a top edge to receive the tongue.

13. The system of claim 1, wherein the triangular cross-section is approximately an isosceles triangular shape.

14. A bracket for mounting an ice ramp to a dock, comprising:
- a triangular cross-section with a bisecting element;
- an angled ice ramp support face for angularly supporting an ice ramp;
- a notch at a lower end of the support face for receiving an edge of an ice ramp;
- a hook that extends from an upper end of the support face that is mountable to a dock top surface; and
- a backplate having a downwardly extending tongue that mates with the catch plate.

15. The bracket of claim 14, where in the triangular cross-section is comprised of two co-planar wall sections.

16. A method for securing an ice ramp system to a dock, comprising:
- securing a catch plate horizontally to a dock side surface;
- securing a support rail to a dock top surface;
- securing a plurality of brackets to the dock side surface, including
  - securing a hook of each bracket to the support rail, and
  - securing a tongue of each bracket to the catch plate; and
- securing a plurality of ice ramps to the brackets.

17. The method of claim 16, wherein each bracket comprises:
- a triangular cross-section with a bisecting element;
- an angled ice ramp support face for angularly supporting an ice ramp;
- a notch at a lower end of the support face for receiving an edge of the ice ramp;
- a hook that extends from an upper end of the support face that is mountable to the dock top surface; and
- a backplate having downwardly extending tongue that mates with the catch plate.

18. The method of claim 17, wherein the hook is angled to fit over the support rail, and
- wherein the angle of the hook is approximately 90 degrees relative to the dock top surface.

19. The method of claim 17, wherein the ice ramps include an angled surface and an ice ramp top surface to rest both on the support face and upper surface of the brackets respectively, wherein the angle of the ice ramps is approximately 125-145 degrees forming the angled surface and the ice ramp top surface for each ice ramp, wherein the ice ramp top surface of the ice ramp top has a handle, wherein the ice ramp top surface of the ice ramp top has a flange extending from a side edge, wherein the flange is connectable to an the ice ramp top surface of an adjacent ice ramp, wherein the flange includes a hole that is alignable with a hole in the adjacent ice ramp to form a pair of aligned holes, and securing the flange with the adjacent ice ramp via the aligned holes and placing a bolt through the aligned holes.

20. The method of claim 17, wherein the catch plate includes an offset along a top edge to receive the tongue.

* * * * *